US006655681B1

(12) United States Patent
Klopfenstein

(10) Patent No.: US 6,655,681 B1
(45) Date of Patent: Dec. 2, 2003

(54) SHEET MATERIAL CONVEYING APPARATUS WITH INDIVIDUALLY-ADJUSTABLE POCKETS

(75) Inventor: Andrew Lynn Klopfenstein, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/662,277

(22) Filed: Sep. 14, 2000

(51) Int. Cl.[7] ..... B65H 29/04
(52) U.S. Cl. ..... 271/206; 271/82; 271/85
(58) Field of Search ..... 271/279, 296, 271/299, 223, 85, 82, 204, 206; 270/52.14, 52.2, 58.23, 58.01, 58.18, 58.19, 58.28, 58.06, 58.025; 414/790.5, 790.6, 790.4

(56) References Cited

U.S. PATENT DOCUMENTS

| | | | | |
|---|---|---|---|---|
| 4,124,203 A | | 11/1978 | Mueller | 270/55 |
| 4,496,141 A | | 1/1985 | Nayate | 270/55 |
| 5,251,888 A | | 10/1993 | Eugster | 270/55 |
| 5,527,025 A | * | 6/1996 | Schlough | 270/58.06 |
| 5,911,416 A | | 6/1999 | Klopfenstein | 271/223 |

* cited by examiner

*Primary Examiner*—David H. Bollinger
(74) *Attorney, Agent, or Firm*—Davidson, Davidson & Kappel, LLC

(57) ABSTRACT

A sheet material conveying apparatus includes a plurality of pockets, each pocket including a setting device for adjusting a height of the pocket when the pocket is stationary so as to define a set height. A sheet delivery section delivers sheet material into the pockets and a release station for releases the sheet material from the pockets. A reset station automatically resets the pockets to the set height. A method and a sheet material pocket are also provided.

20 Claims, 8 Drawing Sheets

SHEET MATERIAL CONVEYING APPARATUS WITH INDIVIDUALLY-ADJUSTABLE POCKETS

BACKGROUND OF THE INVENTION

1. Field of the Invention

The present invention relates generally to a sheet conveying apparatus, for example, for conveying newspapers, and more particularly to a sheet conveying apparatus having pockets moving on a track. The present invention also relates to such pockets and to a method for conveying such pockets.

2. Background Information

U.S. Pat. No. 5,911,416 describes a sheet material conveying apparatus with a plurality of pockets moveable around a track to accept sheet material from sheet material feeders. These pockets permit for example a first outer section of a newspaper to first be fed into the pockets by a first sheet material feeder, and then an inner newspaper section to be inserted between the folds of the first outer newspaper section.

The apparatus of the '416 patent uses a lift cam 20 to move a semicircular actuator gear 150 to rotate a drive shaft 110 so as to set a height for pocket feet 90 arranged on racks 80. A pawl and rachet mechanism prevents the pocket from opening. The sheet material can then be accepted and inserted into the pockets.

To deliver the sheet material, the pawl and ratchet mechanism can then be released by a trip cam 22. Tracks 80 move to a lower position through a biasing spring, so that feet 90 release through operation of a driver cam 130. The sheet material in the pocket can thus move out of the pocket from the bottom to be further conveyed or to be stacked.

U.S. Pat. No. 5,251,888 purports to describe pockets moveable along an endless path. Each pocket is provided with two vertically adjustable stops mounted displaceably in a pocket carrier. A guide member purportedly can be set to vertically adjust the stops as the pockets are moved along the endless path.

These patents do not provide setting devices directly on the pockets for setting when the pockets are stationary.

BRIEF SUMMARY OF THE INVENTION

An object of the present invention is to permit the pockets to be set to a desired height while stationary.

The present invention provides a sheet material conveying apparatus comprising a plurality of pockets, each pocket including a setting device for adjusting a height of the pocket when the pocket is stationary so as to define a set height, a sheet delivery section for delivering sheet material into the pockets, a release station for releasing the sheet material from the pockets, and a reset station for resetting the pockets to the set height.

The present invention permits the pockets to be set while stationary to the set height and to operate continuously at the set height. To change a pocket height, the apparatus is stopped and the setting devices for each pocket are changed to a new height. The reset station may include a movable resent incline ramp which is then also set for the new height, and may also include a lock engagement device.

Each pocket includes a lock device for the setting device, the lock device including a lock ring with a single point ratchet and a pawl for interacting with the lock ring.

The setting device preferably includes a height indicator fastened to a semicircular or reset gear, which is attached to a reset cam follower. A knob gear has an outer gear section geared to the semi-circular gear and rotatably fixed to a shaft which can set the height of the pockets. The lock ring fits around the shaft, and the knob gear is selectively engageable with the lock ring, by sliding of the knob gear axially with respect to the shaft. When the lock ring engages the knob gear, both elements rotate together. When the knob gear is disengaged from the lock ring by sliding the knob gear, for example, manually, the lock ring is free to rotate about the shaft, while the knob gear remains rotationally fixed with respect to the shaft.

The semicircular gear preferably is spring-loaded in a direction which causes the fingers to drop to a bottom of the pocket and release. The unlocking of the lock mechanism at the release station thus causes the fingers to release and to release any sheet material in the pocket.

The present invention also provides a sheet material pocket comprising a first wall, a second wall spaced apart from the first wall so as to define a sheet receiving area, at least one finger movable with respect to the first wall for defining a pocket bottom, the at least one finger releasable so that the pocket bottom opens, a shaft connected to the at least one finger for moving the at least one finger, a knob gear rotationally fixed with respect to the shaft and slidable with respect to the shaft, and a lock ring selectively engageable with the knob gear.

The present invention also provides a method for setting a height of a plurality of pockets comprising the steps of:

individually setting the height of each of the plurality of pockets using a setting device on each of the plurality of pockets so as to define a common set height;

locking the setting device on each of the plurality of pockets using a single point ratchet; and moving the pockets in an loop.

The method preferably includes providing a first set of sheet material to the pockets while the pockets are moving, and then providing a second set of sheet material to the pockets.

The method also advantageously may include the step of releasing the pockets so that the sheet material may be delivered, for example, to a delivery station.

The setting device preferably is spring-loaded to force a downward movement and release of the fingers, so that a setting which causes the pocket bottom to move upwardly operates against the spring-loading.

The method further may include setting a height of a reset ramp to correspond to the common set height, and that a reset cam follower of the setting device interacts with the reset ramp to return the fingers to the common set height. A lock engagement device can then lock the fingers in place. The step of setting the reset ramp height to correspond to the common set height is highly advantageous, otherwise the locking device may bang or damage the single point ratchet, or even reset the pockets to an improper height.

The present invention provides a simple method and device for resetting pocket height and permits for manual resetting of a pocket height.

BRIEF DESCRIPTION OF THE DRAWINGS

A preferred embodiment of the present invention is described below by reference to the following drawings, in which.

DETAILED DESCRIPTION

Figure 1:
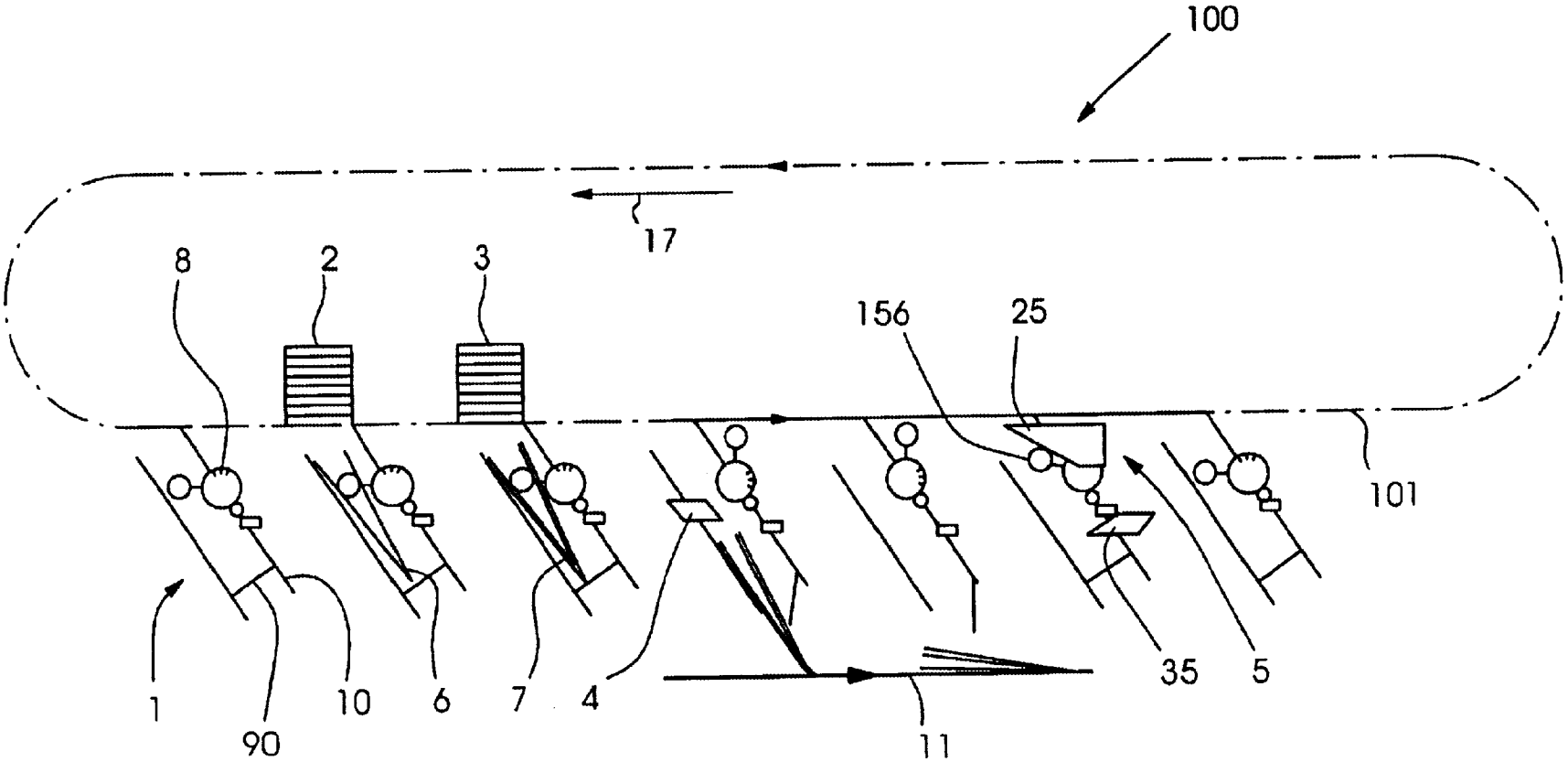
FIG. 1 shows a schematic view of a sheet material conveying apparatus according to the present invention.

FIG. 1 shows a schematic view of a sheet material conveying apparatus 100 having an endless track 101 for transporting a plurality of pockets 10 in direction 17. Each pocket 10 includes fingers 90 for defining a pocket height, an individual height setting mechanism 8 and a releasable lock mechanism 9 for the height setting mechanism 8.

At a setting area 1, each pocket 10 can be set, for example manually, by the setting mechanism 8 to move the fingers 90 to a desired height, for example for receiving 10½ inch folded products. The pockets 10 are stationary during setting, and the setting can occur outside the setting area as well, for example by an operator moving about track 101. Alternatively the pockets could be moved to the setting area, the apparatus stopped, and each pocket set.

After a pocket is set to a desired height, the setting mechanism 8 is then locked in place by the lock mechanism 9 so that the pocket height is set. After all the pockets are set, the pockets 10 are moved to pass beneath a first sheet material feed station 2 where, for example, a folded cover section 6 of a newspaper or other printed product is delivered into the pocket 10. At a second and optional sheet material feed station 3, a second section may be inserted between the cover section 6 to form a final printed product 7.

The pockets 10 can then pass a release station 4 which releases lock mechanism 9. Setting mechanism 8, which is spring-loaded, then releases the fingers 90 so that the bottom of pocket 10 opens, and the products 7 are delivered, for example to a conveyor belt 11.

As pockets 10 continue past release station 4, pockets 10 pass through a reset station 5 which includes a movable incline reset ramp 25 for interacting with a reset cam follower 156 of setting mechanism 8 and a lock engagement device 35 for locking lock mechanism 9. The pockets 10, which are preferably all set to a common height, are then reset to the common height by the reset ramp 25, and locked into place by lock engagement device 35 engaging lock mechanism 9.

Figure 2:
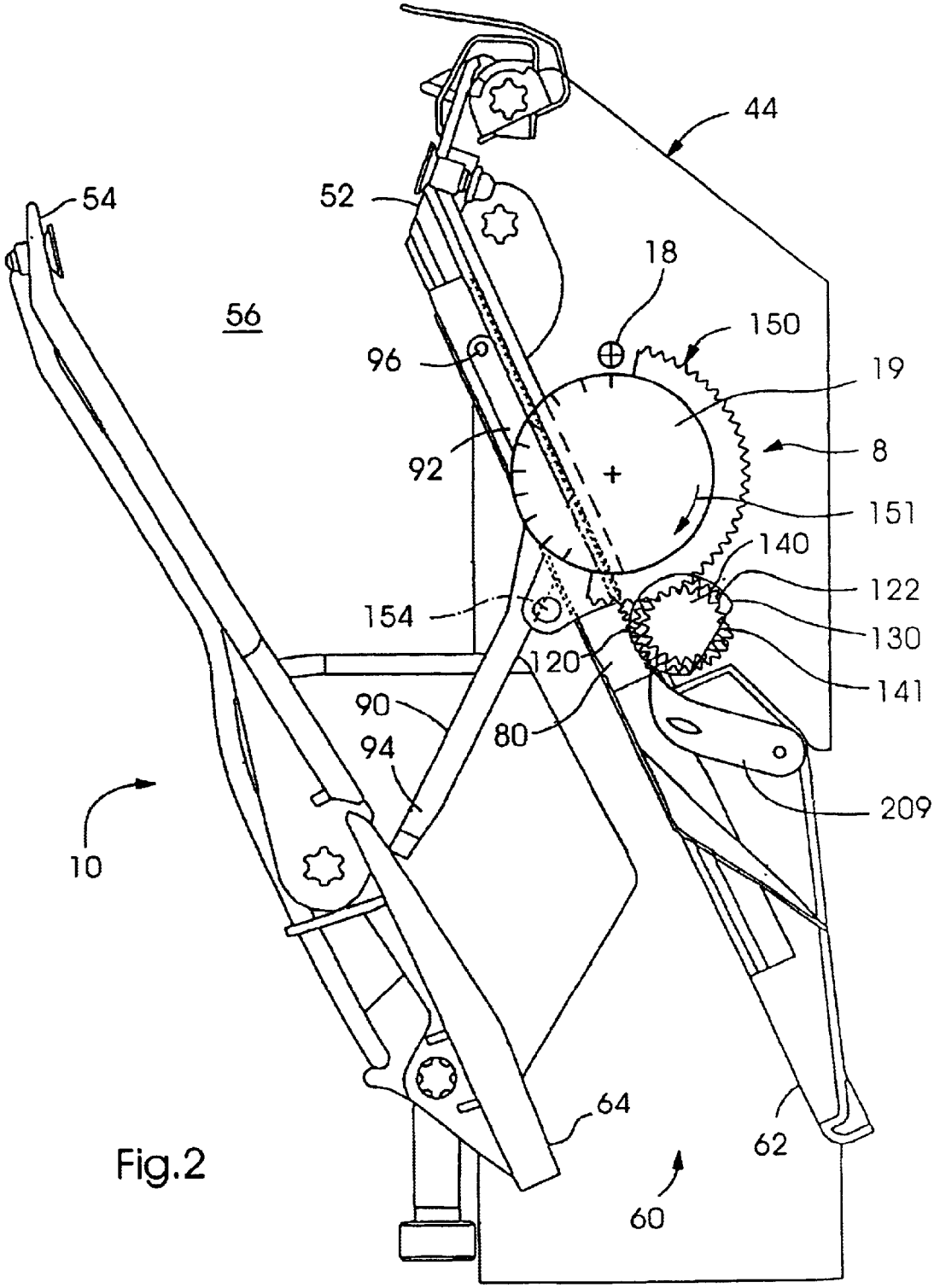
FIG. 2 shows a partial side view of a pocket according to the present invention, with certain elements omitted for clarity purposes.
Figure 3:
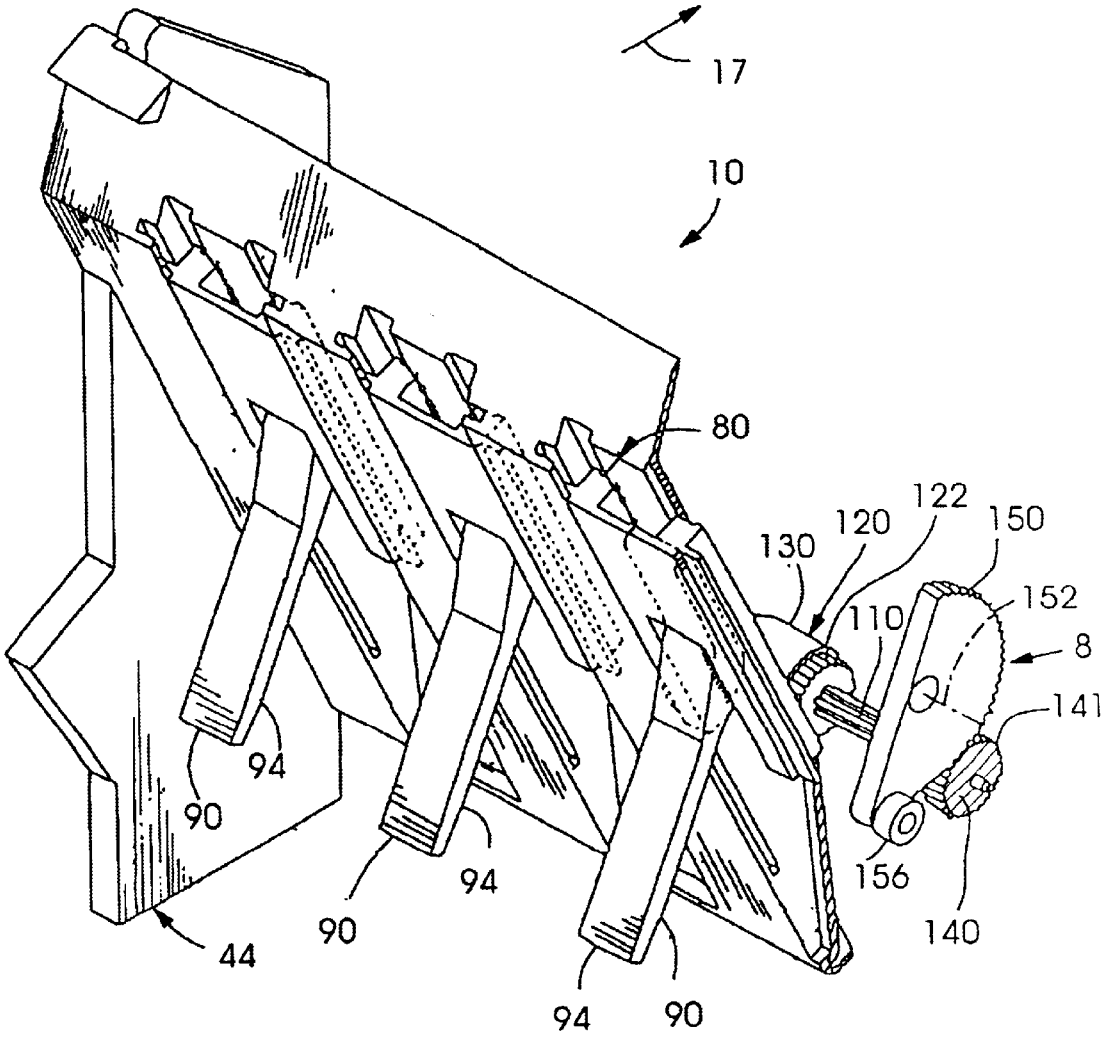
FIG. 3 shows a partial perspective view of a pocket according to the present invention with certain elements omitted for clarity purposes.
Figure 4:
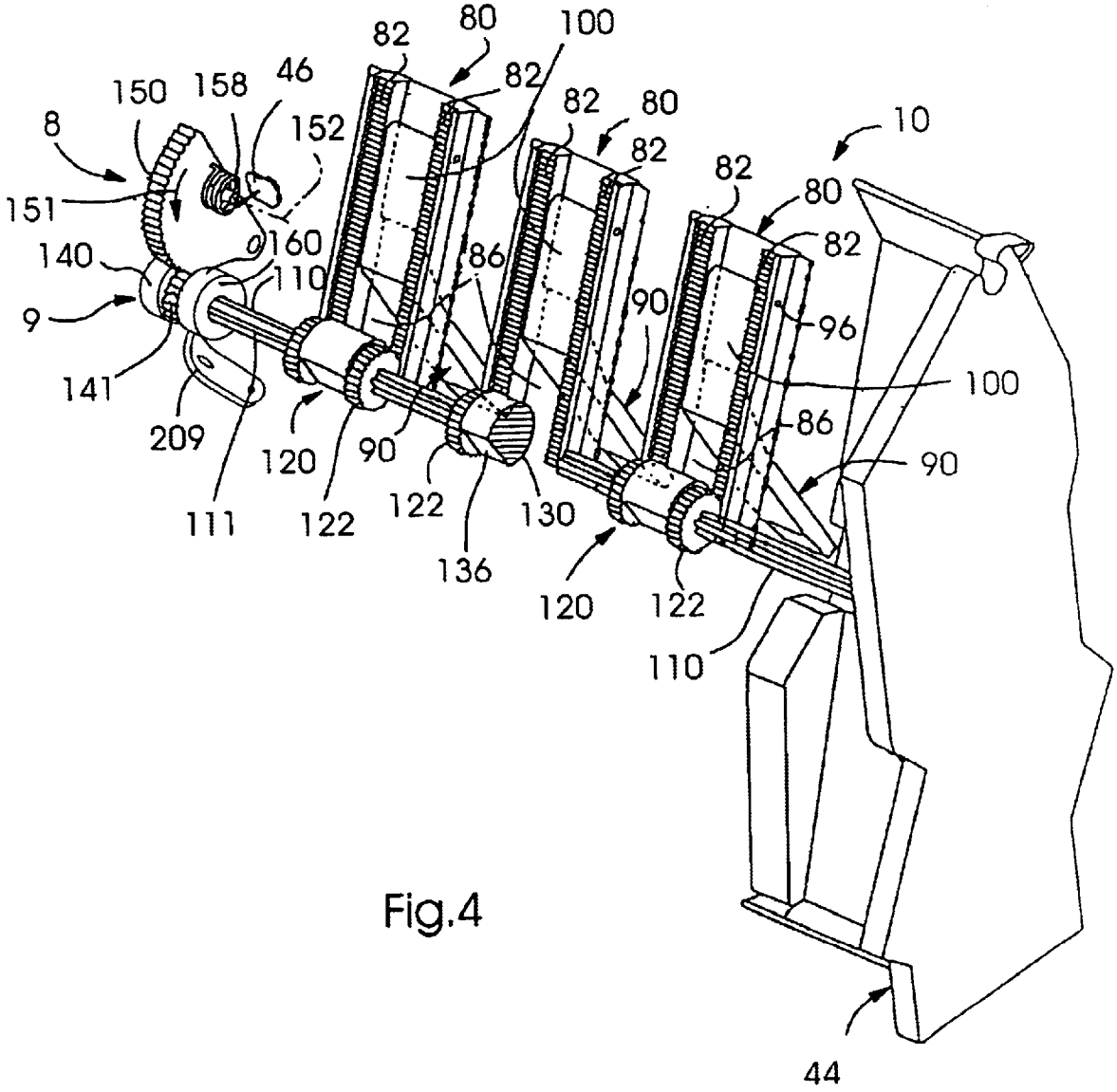
FIG. 4 shows another partial perspective view of a pocket according to the present invention with certain elements omitted for clarity purposes.

FIGS. 2, 3 and 4 show more details of pocket 10. Pocket 10 has an upper rear wall 54 and an upper front wall 52, in between which is an opening 56 for accepting sheet material, as well as a side wall 44. Pocket 10 also may have a lower rear wall 64 and a lower front wall 62. Slidable with respect to wall 52 is a rack 80, on which fingers 90 are supported. The fingers 90 are supported on rack 80 by a pivot 96 attached to a first section 92 of finger 90. A second section 94 of finger 90 can define a pocket bottom when fingers 90 are in a closed position. Rack 80 includes teeth 82 (FIG. 4) which interact with a gear 122 of a pinion 120 (FIGS. 3 and 4), which also includes a release cam 130. Pinions 120 are located on a shaft 110 rotatably supported in walls 44 and 46. At the wall 46 (FIG. 4, not fully shown to improve clarity), an end 111 of shaft 110 connects to a setting knob gear 140. Knob gear 140 has an interior surface which ensures that knob gear 140 rotates in a fixed relationship with shaft 110. However, knob gear 140 can slide axially with respect to shaft 110 for selective interlocking with a lock ring 160 (interior to gear 140 and visible only in FIG. 4), which forms part of lock mechanism 9. Lock mechanism 9 also includes a pawl 209 for interacting with a single ratchet on the exterior of ring 160. Knob gear 140 is shown in FIGS. 2, 3 and 4 only in part, with a knob for manually pulling and turning the gear not being shown. The details of knob gear 140 and its interaction with lock ring 160 will be described in more detail with respect to FIGS. 5 and 6.

FIG. 3 shows how fingers 90 extend through the front wall. Release cam 130 can interact with a release surface 100 (FIG. 4) of finger 90 located in an opening 86 between teeth 82 when fingers 90 are fully lowered, so that the fingers rotate away from the rear wall and release any products in the pocket 10. Release of the fingers 90 is similar to the release of the feet in U.S. Pat. No. 5,911,416, the entire disclosure of which is hereby incorporated by reference herein.

FIG. 2 shows knob gear 140 interacting with a semicircular setting gear 150 having a pocket height indicator 19, which may include numbers or other identification data next to the shown markings. On one side of semicircular gear 150 is a reset cam follower 156 held rotationally at an axis 154.

A marking 18 on wall 46 provides a stationary reference point for indicator 19. The FIG. 2 setting shows a highest possible pocket setting. By rotating knob 140 in FIG. 2 counterclockwise when lock mechanism 9 is disengaged, an operator can lower the pocket fingers 90 since shaft 110 is likewise rotated. Semicircular gear 150 and indicator 19 thus likewise rotate about axis 152 so as to indicate the height of the fingers and thus the setting of the pockets.

As shown in FIG. 4, semicircular gear 150 is attached to a spring 158 to spring-load gear 150 in a direction 151, as also shown in FIG. 2.

An operator selects a proper setting by pulling the knob gear 140 outwardly so as to disengage from lock ring 160 and rotating knob gear 140, which is rotationally fixed with respect to shaft 110. The lock ring 160 remains held in place by pawl 209, and shaft 110 is free to rotate with respect to lock ring 160. Pawl 209 is in a locked upward position and interacts with a single ratchet on a lock ring 160. Once the rotation of knob gear 140, while disengaged from the lock ring 160, moves the fingers to the desired location, the operator releases knob gear 140 so that knob gear 140 again is rotationally fixed to lock ring 160, for example through star gearing. The pocket is thus set to a new height.

Figure 5:
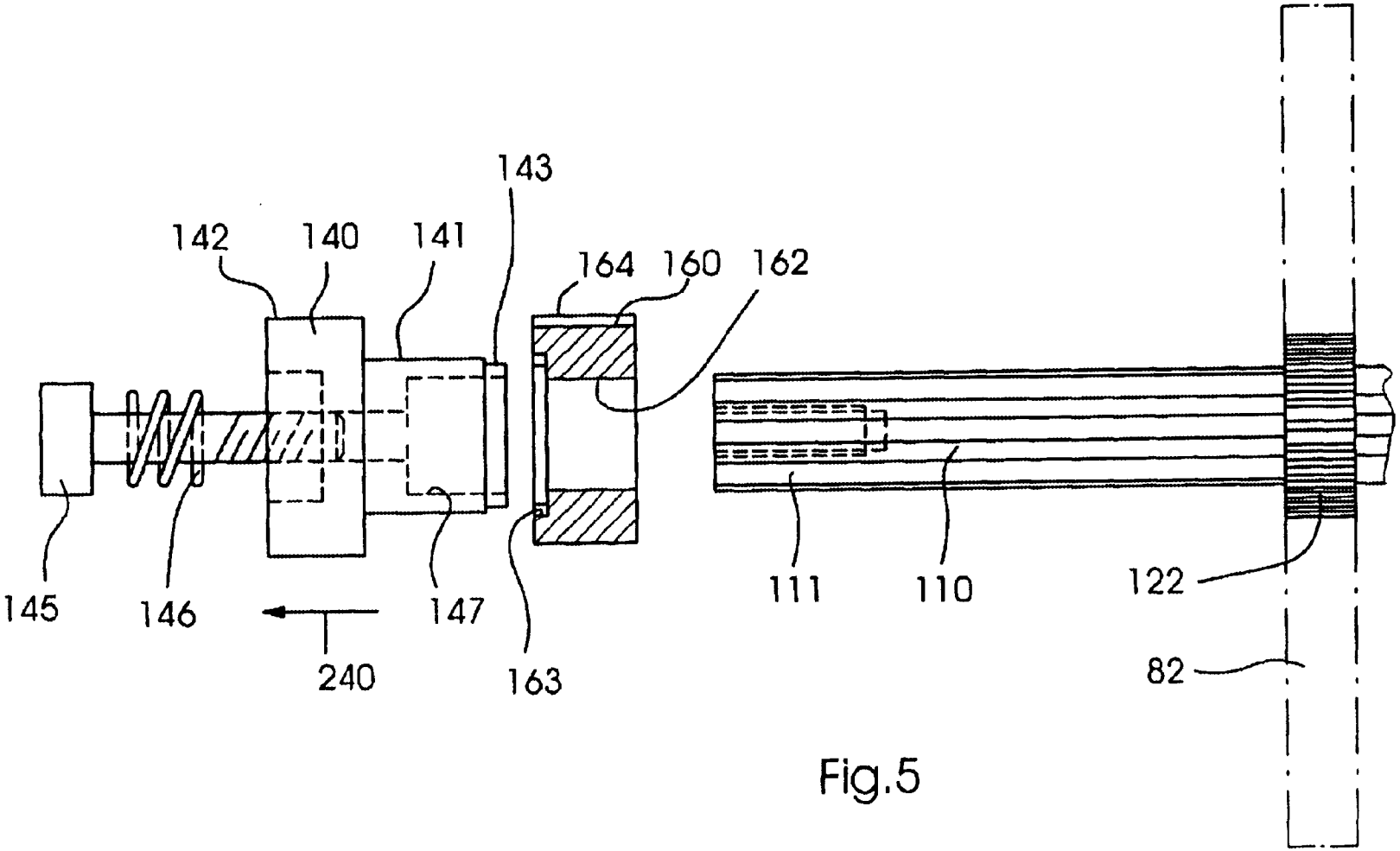
FIGS. 5 and 6 show more detail of the setting device for setting a finger height according to the present invention.
Figure 6:
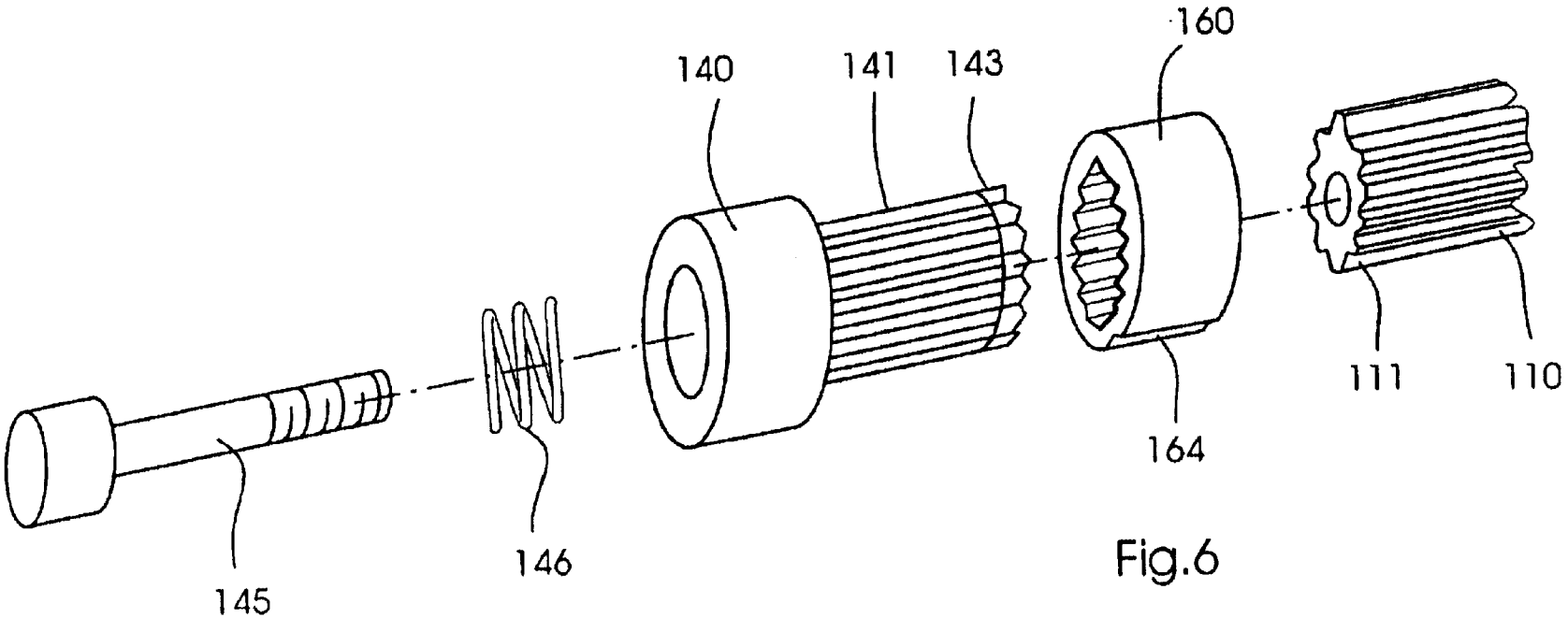

FIG. 5 shows an exploded view of the details of knob gear 140. End 111 of shaft 110 fits in interiorly toothed hole 147 of knob gear 140. End 111 is fixed to a screw 145 which abuts knob gear 140 through a spring 146. Knob gear 140 thus can be pulled against the force of spring 146 in the direction of arrow 240 so as to slide axially with respect to shaft 110, however always remaining rotationally fixed with shaft 110.

Interior to knob gear 140 with respect to shaft end 111 is lock ring 160, which interacts fixedly through an interior star gear 163 with an exterior star gearing 143 of knob gear 140 when knob gear 140 is not pulled axially against the spring force of spring 146. When pulled axially against the spring force (i.e. to the left in FIG. 5), knob gear 140 releases from lock ring 160, which then is freely rotatable about shaft 110 due to a smooth inner surface section 162 which rests on shaft 110.

Knob gear 140 has a knob portion 142 for permitting an operator to firmly grip the knob gear 140 and pull and turn the gear 140. External gear teeth 141 interact with semicircular gear 150 (FIG. 2). Thus rotating knob gear 140 causes semicircular gear 150 to rotate.

Figure 7:
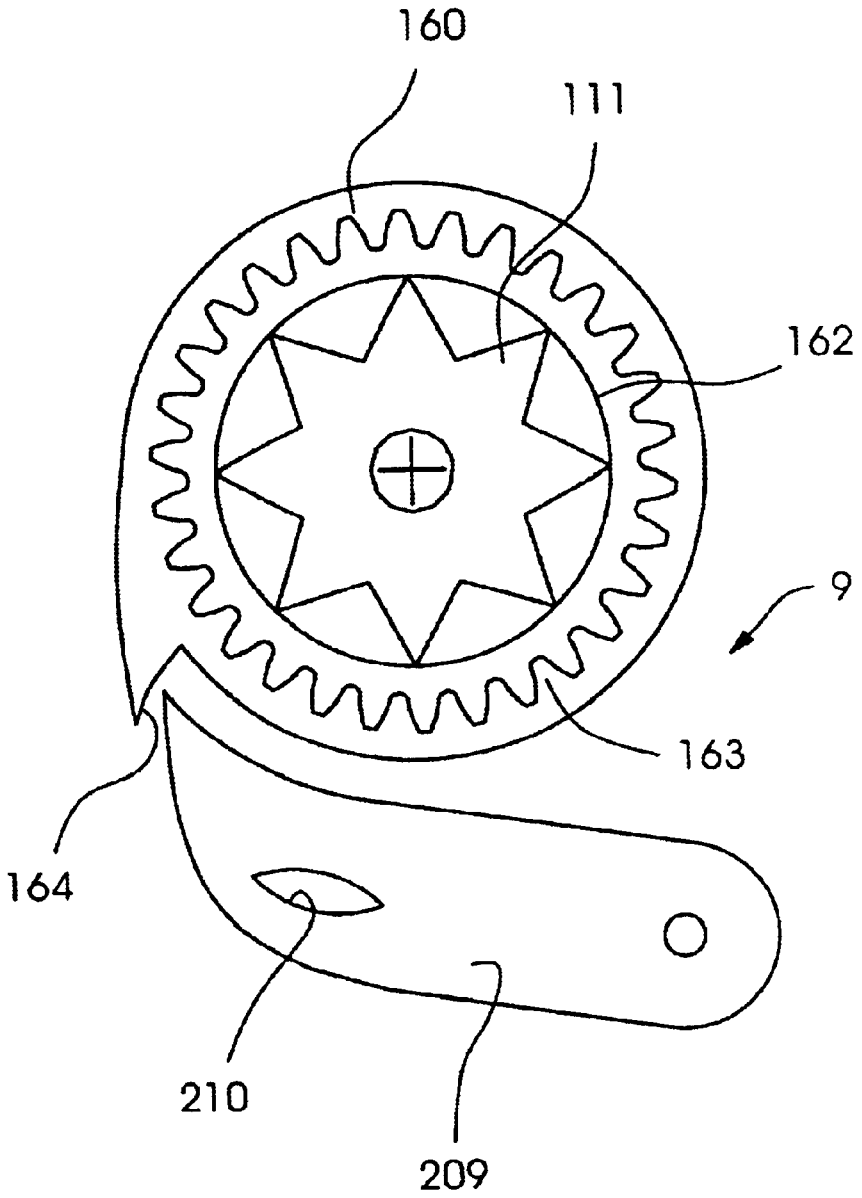
FIG. 7 shows more detail of the lock mechanism of FIG. 1.

Lock ring 160 has a single ratchet 164 on an external surface, which can interact with a pawl 209, as shown in FIG. 7. An extension 210 extends outwardly from pawl 209, for permitting pawl 209 to move between an upward and a downward position. The pawl may be spring-loaded to favor one position, or to click into both positions.

Figure 8:
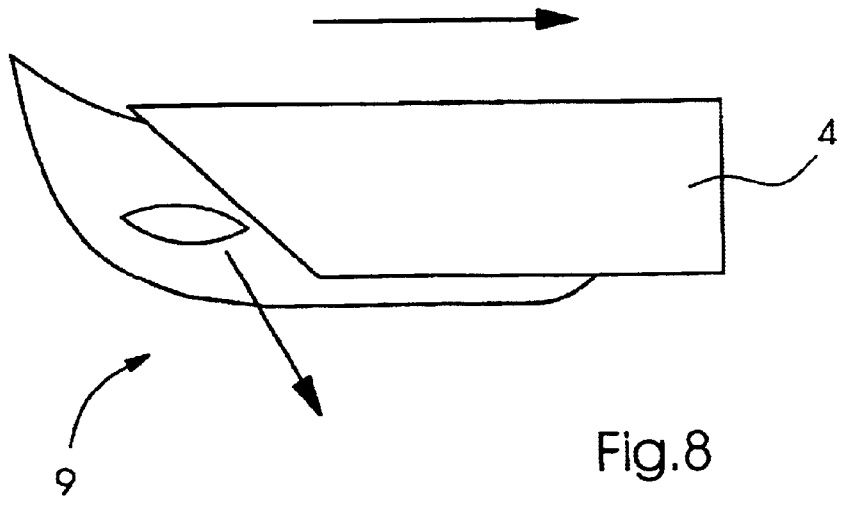
FIG. 8 shows more detail of the release station of FIG. 1.

FIG. 8 shows the release station 4, which moves pawl 209 of lock mechanism 9 downwardly to a released position as a pocket passes station 4 in direction 17. Pawl 209 thus moves away from ratchet 164, by the interaction of a sloped surface 304 of station 4 forcing extension 210 downwardly. Once pawl 209 moves downwardly, lock ring 160 moves counterclockwise (FIG. 7). This counterclockwise movement occurs because of the spring loading of semicircular gear 150 in direction 151 (FIG. 2), which rotates knob gear 140 counterclockwise (FIG. 2). Since shaft lock ring 160, knob gear 140 and shaft 111 are all rotationally fixed at the release station, they all rotate together. Shaft 111 thus moves fingers 90 downwardly through gear 122 and rack 80 until cams 130 cause the fingers to open and release the sheet material in pocket 10.

Figure 9:
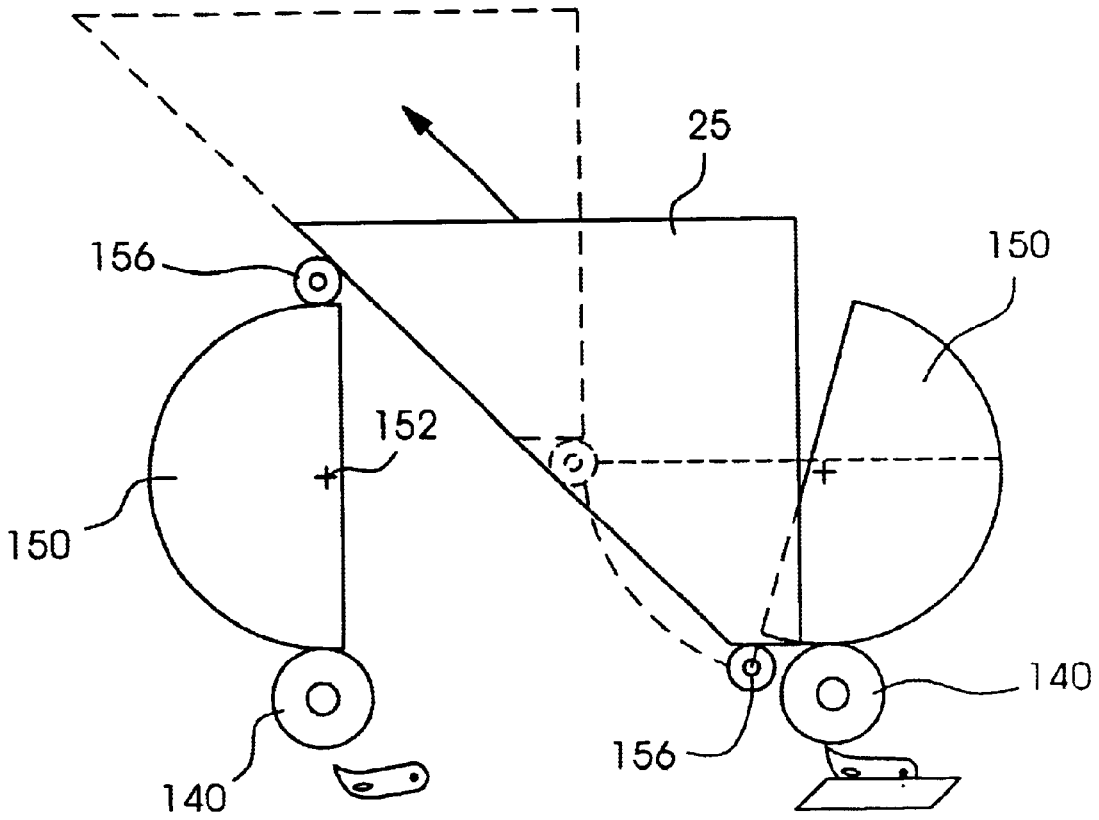
FIG. 9 show more detail of the reset station of FIG. 1.

Once released, the pockets 10 are in a position A as shown in FIG. 9, with the reset cam follower 156 at a top position. As pocket 10 moves past reset station 5, reset cam follower 156 is forced downwardly by incline ramp 25 to original set position B. Because the reset ramp 25 is set to the proper height, the single ratchet 164 of lock ring 160 is in the proper position at the bottom of ramp 25 for a lock engagement device 35 to move the extension 210 of pawl 209 upwardly and engage ratchet 164. The pockets 10 thus are properly reset for continuous operation around track 101 without any stopping or cessation necessary.

The reset ramp 25 preferably should be set to a height corresponding to a common pocket height of all pockets. Reset ramp 25 can be moved incrementally in direction 225. Thus if the pockets 10 are all reset for a different pocket height, reset ramp 25 should be moved to a position corresponding to the different pocket height. Dotted lines in FIG. 9 show a midway reset ramp position for a different pocket height. In this case, the cam follower 156 is not moved as far downwardly, so that the fingers are not moved upwardly as much and the pocket height (depth) is greater; for example, resetting the height for 12 inch folded products instead of 10½ inch folded products.

If the ramp is not set for a proper reset height, the pawl 209 will not engage directly at the single ratchet and thus the ring will rotate until the pawl contacts the single ratchet. This rotation may cause damage to lock ring 160 (if the ramp is set too low).

Operation of the apparatus 100 may be summarized as follows:

With the apparatus in a stationary position, for each pocket 10, knob gear 140 is pulled out and disengaged from lock ring 160 and then turned to set indicator 19 to the desired pocket height for fingers 90 with pawl 209 in an engaged position. The height should be the same for each pocket 10. The knob gear 140 is then released, so that the lock ring 160 is again rotationally fixed with respect to knob gear 140 and shaft 110. All of the pockets 10 thus are locked at their desired set height. The incline ramp 25 is then set to correspond to the common height for the pockets.

The pockets 10 then receive sheet material from delivery stations 2 and 3. When ready for release, the pockets pass by release station 4, which causes the pawl 209 to release and the pocket fingers to move downwardly and release the indexed or collated sheet material 7.

The pockets are then reset at reset station 5, by cam follower 156 moving downwardly along ramp 25 to move the fingers 90 up to the proper height. Lock engagement device 35 moves pawl 209 back to lock lock ring 160 and the fingers 90 in the proper height.

The apparatus can thus continue operating at the set height. If a new set height is desired, the machine is stopped and each pocket 10 and the incline ramp 25 reset to a new height.

"Ramp" as defined herein can include any cam shaped for moving a cam follower in a desired direction. "Ratchet" as defined herein can include any stop for a pawl or similar device to a pawl.

What is claimed is:

1. A sheet material conveying apparatus comprising:

a plurality of pockets, each pocket including a setting device for adjusting a height of the pocket when the pocket is stationary so as to define a set height;

a sheet feed section for delivering sheet material into the pockets;

a release station for releasing the sheet material from the pockets; and a reset station for automatically resetting the pockets to the set height.

2. The apparatus as recited in claim 1 wherein the reset station includes a movable reset incline ramp and a lock engagement device.

3. The apparatus as recited in claim 1 wherein each pocket includes a lock device for the setting device.

4. The apparatus as recited in claim 3 wherein the lock device including a lock ring with a single point ratchet and a pawl for interacting with the lock ring.

5. A sheet material conveying apparatus comprising:

a plurality of pockets, each pocket including a setting device for adjusting a height of the pocket when the pocket is stationary so as to define a set height;

a sheet feed section for delivering sheet material into the pockets;

a release station for releasing the sheet material from the pockets, and a reset station for automatically resetting the pockets to the set height;

wherein the setting device includes a reset gear and a height indicator fastened to the reset gear.

6. The apparatus as recited in claim 5 wherein a reset cam follower is attached to the reset gear.

7. The apparatus as recited in claim 5 wherein the setting device includes a knob gear having an outer gear section geared to the reset gear and rotatably fixed to a shaft which can set the height of the pockets.

8. The apparatus as recited in claim 7 further including a lock ring fitting around the shaft, the knob gear being selectively engageable with the lock ring by sliding of the knob gear axially with respect to the shaft.

9. The apparatus as recited in claim 8 wherein the lock ring has a single outer ratchet for engaging with a pawl.

10. The apparatus as recited in claim 5 wherein the reset gear is spring-loaded in a direction which causes fingers of the pocket to drop to a bottom of the pocket and release.

11. A sheet material pocket comprising:

a first wall;

a second wall spaced apart from the first wall so as to define a sheet material receiving area;

at least one finger movable with respect to the first wall for defining a pocket bottom, the at least one finger releasable so that the pocket bottom opens;

a knob gear for moving the at least one finger; and a lock ring selectively engageable with the knob gear.

12. The pocket as recited in claim 11 wherein the lock ring has a single ratchet at an outer surface.

13. The pocket as recited in claim 11 wherein the lock ring is freely rotatable about a shaft when not engaged with the knob gear.

14. A method for setting a height of a plurality of pockets comprising the steps of:

individually setting the height of each of the plurality of pockets using a setting device on each of the plurality of pockets so as to define a common set height;

locking the setting device on each of the plurality of pockets through a single point ratchet; and moving the pockets in an endless loop.

15. The method as recited in claim 14 further comprising providing a first set of sheet material to the pockets while the pockets are moving.

16. The method as recited in claim 15 further comprising providing a second set of sheet material to the pockets.

17. The method as recited in claim 14 further comprising releasing the pockets so that the sheet material may exit the pockets.

18. The method as recited in claim 14 wherein the setting device is spring-loaded to force a downward movement and release of the fingers.

19. The method as recited in claim 14 further including setting a height of a reset ramp to correspond to the common set height, a reset cam follower of the setting device interacting with the reset ramp to return the fingers to the common set height.

20. The method as recited in claim 14 further comprising manually rotating a lock ring having the single point ratchet.

* * * * *